US006144818A

United States Patent [19]

Ohtani

[11] Patent Number: 6,144,818

[45] **Date of Patent: *Nov. 7, 2000**

[54] IMAGE FORMING APPARATUS HAVING A FINISHING SECTION INCLUDING IMPROVED STAPLING FUNCTION

[75] Inventor: Masaki Ohtani, Kanagawa, Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/149,040

[22] Filed: Sep. 8, 1998

[30] Foreign Application Priority Data

Sep. 12, 1997 [JP] Japan ..... 9-248087

[51] Int. Cl.[7] ..... G03G 15/00

[52] U.S. Cl. ..... 399/81; 271/184; 399/410

[58] Field of Search ..... 399/81, 85, 388, 399/389, 393, 405, 407, 408, 410; 270/32, 37, 58.01, 58.09; 271/184, 288; 358/296, 300, 302

[56] References Cited

U.S. PATENT DOCUMENTS 5,229,812 7/1993 Toyama et al. ..... 399/410 X
5,481,354 1/1996 Nakajima ..... 399/410 X
5,508,798 4/1996 Yamada ..... 399/410

FOREIGN PATENT DOCUMENTS 63-74075 4/1988 Japan .
4-301498 10/1992 Japan .
4-341892 11/1992 Japan .
5-185764 7/1993 Japan .
5-318961 12/1993 Japan .
6-286930 10/1994 Japan .
7-288675 10/1995 Japan .

*Primary Examiner*—Matthew S. Smith
*Assistant Examiner*—Hoan Tran
*Attorney, Agent, or Firm*—Oblon, Spivak, McClelland, Maier & Neustadt, P.C.

[57] ABSTRACT

An image forming apparatus is capable of effecting, without resorting a precise staple command, adequate finishing matching with an environment including the condition of papers, thereby reducing defective printings when stapling is desired. When a rough stapling position, e.g., the top left corner or the top right corner of a paper is designated via a rough command inputting device, papers can be stapled in a desired pattern with high probability.

12 Claims, 9 Drawing Sheets

Fig. 6

| PATTERN / PAPER SIZE ON TRAY | | TOP LEFT OBLIQUE | TOP RIGHT OBLIQUE | LEFT 2-POINT | TOP 2-POINT | RIGHT 2-POINT | TOP LEFT HORIZONTAL | TOP RIGHT HORIZONTAL |
|---|---|---|---|---|---|---|---|---|
| A3R,B4R<br>DLR,LGR<br>A4R,B5R<br>LTR,EXR | SIMPLEX | CANCEL | 180 | CANCEL | 180 | CANCEL | 180 | 180 |
| | DUPLEX TOP | CANCEL | 180 | CANCEL STAPLE | 180 | CANCEL STAPLE | 180 | 180 |
| | DUPLEX LEFT | CANCEL | CANCEL STAPLE | CANCEL | CANCEL STAPLE | CANCEL STAPLE | 180 | CANCEL STAPLE |
| | DUPLEX RIGHT | CANCEL STAPLE | 180 | CANCEL STAPLE | CANCEL STAPLE | CANCEL | CANCEL STAPLE | 180 |
| OTHERS | | CANCEL | | | | | | |
| PARAMETER | | 0 | 12 | 2 | 14 | 10 | 15 | 13 |

FIG. 7

| PAPER SIZE ON TRAY \ PATTERN | | TOP LEFT OBLIQUE | TOP RIGHT OBLIQUE | LEFT 2-POINT | TOP 2-POINT | RIGHT 2-POINT | TOP LEFT VERTICAL | TOP RIGHT VERTICAL |
|---|---|---|---|---|---|---|---|---|
| A3R,B4R | SIMPLEX | 0 | CANCEL | 0 | CANCEL | 180 | 0 | 180 |
| DLR,LGR | DUPLEX TOP | 0 | CANCEL | CANCEL STAMPLE | CANCEL | CANCEL STAMPLE | 0 | 180 |
| A4R,B5R | DUPLEX LEFT | 0 | CANCEL STAMPLE | 0 | CANCEL STAMPLE | CANCEL STAMPLE | 0 | CANCEL STAMPLE |
| LTR,EXR | DUPLEX RIGHT | CANCEL STAMPLE | CANCEL | CANCEL STAMPLE | CANCEL STAMPLE | 180 | CANCEL STAMPLE | 180 |
| OTHERS | | CANCEL | | | | | | |
| PARAMETER | | 0 | 12 | 2 | 14 | 10 | 1 | 11 |

*FIG. 8*

| PAPER SIZE ON TRAY \ PATTERN | | | TOP LEFT OBLIQUE | TOP RIGHT OBLIQUE | LEFT 2-POINT | TOP 2-POINT | RIGHT 2-POINT | TOP LEFT VERTICAL | TOP RIGHT VERTICAL |
|---|---|---|---|---|---|---|---|---|---|
| A3,B4,DL,LG | | | | | | | | | |
| A4,B5 LT,EX | SIMPLEX | | 0 | CANCEL | 0 | CANCEL | 180 | 0 | 180 |
| | DUPLEX | TOP | 0 | CANCEL | CANCEL STAMPLE | CANCEL | CANCEL STAMPLE | 0 | 180 |
| | | LEFT | 0 | CANCEL STAMPLE | 0 | CANCEL STAMPLE | CANCEL STAMPLE | 0 | CANCEL STAMPLE |
| | | RIGHT | CANCEL STAMPLE | CANCEL | CANCEL STAMPLE | CANCEL STAMPLE | 180 | CANCEL STAMPLE | 180 |
| OTHERS | | | CANCEL | | | | | | |
| PARAMETER | | | 0 | 12 | 2 | 14 | 10 | 1 | 11 |

Fig. 9

| PATTERN / PAPER SIZE ON TRAY | | | | | | | | | | | | | | | | | | | | | | | |
|---|---|---|---|---|---|---|---|---|---|---|---|---|---|---|---|---|---|---|---|---|---|---|---|
| | | ABC | TOP LEFT OBLIQUE | ABC | TOP RIGHT OBLIQUE | ABC | LEFT 2-POINT | ABC | TOP 2-POINT | ABC | RIGHT 2-POINT | ABC | TOP LEFT HORIZONTAL | ABC | TOP RIGHT HORIZONTAL |
| A3,B4,DL,LG | | | | | | | | | | | | | | | |
| A4,B5 LT,EX | SIMPLEX | | CANCEL | | 180 | | CANCEL | | 180 | | CANCEL | | 180 | | 180 |
| | DUPLEX | TOP | CANCEL | | 180 | | CANCEL STAPLE | | 180 | | CANCEL STAPLE | | 180 | | 180 |
| | | LEFT | CANCEL | | CANCEL STAPLE | | CANCEL | | CANCEL STAPLE | | CANCEL STAPLE | | 180 | | CANCEL STAPLE |
| | | RIGHT | CANCEL STAPLE | | 180 | | CANCEL STAPLE | | CANCEL STAPLE | | CANCEL | | CANCEL STAPLE | | 180 |
| OTHERS | | | CANCEL | | | | | | | | | | | | |
| PARAMETER | | | 0 | | 12 | | 2 | | 14 | | 10 | | 15 | | 13 |

| |
|---|
| Fig. 11A |
| Fig. 11B |

IMAGE FORMING APPARATUS HAVING A FINISHING SECTION INCLUDING IMPROVED STAPLING FUNCTION

BACKGROUND OF THE INVENTION

1. Field of the Invention

The present invention relates to a printer, copier or similar image forming apparatus and, more particularly, to an image forming apparatus connectable to a computer or similar host and having a printing function and including a finisher or MFP (Multi Function Peripheral) with a stapling function.

2. Discussion of the Background

Generally, a person intending to prepare a text on, e.g., a host computer and produce a corresponding printing is not aware of the size of papers stacked on each paper cassette of a printer or the direction of paper feed (short-edge feed or long-edge feed). This is particularly true in a LAN (Local Area Network) or similar network environment in which a printer is, in many cases, absent around a host.

The above environment does not matter at all so long as a person simply desires to produce a printing. However, when use is made of a printer with a finisher having, e.g., a stapling function and when a person selects the stapling function, the person must designate a precise stapling pattern by troublesome operation. Moreover, a stapling pattern other than desired one is often set up because the environment including the printing direction and paper feed direction are also related to actual stapling. That is, in the event of stapling, printings are often defective when the environment of the printer is taken into account.

Technologies relating to the present invention are also disclosed in, e.g., Japanese Patent Laid-Open Publication Nos. 63-74075, 4-301498, 4-341892, 5-185764, 5-318961, 6-286930, and 7-288675.

SUMMARY OF THE INVENTION

It is therefore an object of the present invention to provide an image forming apparatus capable of effecting, without resorting precise staple commands, adequate finishing matching with an environment including the condition of papers, thereby reducing defective printings when stapling is desired.

An image forming apparatus of the present invention includes a paper feed section including a paper tray allowing papers to be selectively stacked in a short-edge feed position or a long-edge feed position, depending on the size of the papers. An image forming section forms, based on at least print data, paper size, paper feed direction and printing direction received from a host, an image and transfers it to the paper fed from the paper feed section. A paper discharge section discharges the paper to which the image has been transferred by the image forming section. A finishing section has a stapling function for stapling the papers discharged by the paper discharge section in, among a plurality of patterns each being representative of a particular combination of a stapling point and a stapling direction, a particular pattern selected on the basis of the paper feed direction of the paper and a staple command. Preselected rough command patterns each being representative of a particular combination of a printing direction, paper feed direction and stapling point in relation to the plurality of patterns are set. A rough command inputting section allows a staple command to be roughly input in terms of the printing direction, paper feed direction, and stapling point. A decision section determines, when the staple command is roughly input via the rough command inputting section, a stapling pattern by referencing the paper feed direction, paper feed direction and rough command patterns.

BRIEF DESCRIPTION OF THE DRAWINGS

The above and other objects, features and advantages of the present invention will become apparent from the following detailed description taken with the accompanying drawings in which:

FIGS. 6–9 each shows specific stapling patterns available with a conventional precise command mode;

DESCRIPTION OF THE PREFERRED EMBODIMENTS

Figure 1:
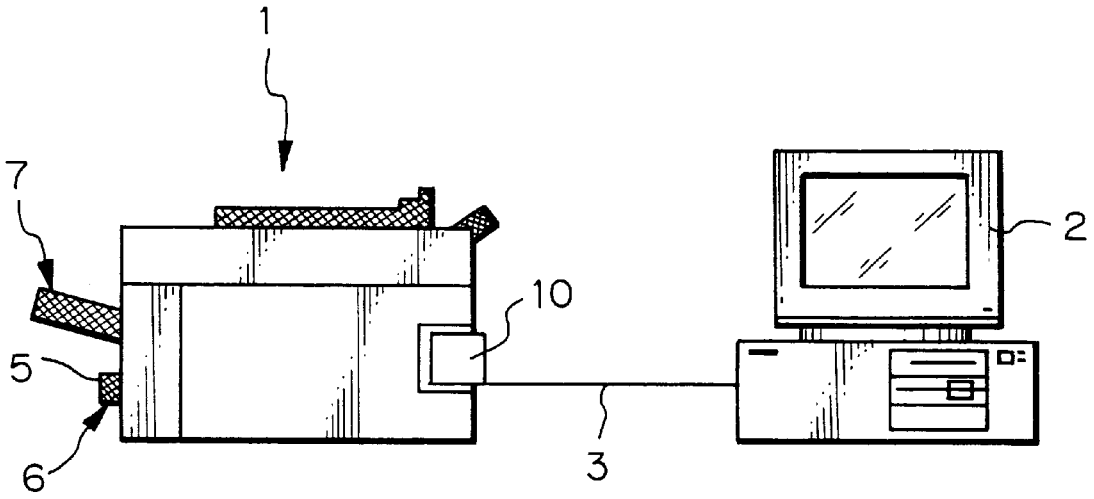
FIG. 1 shows a specific system to which an image forming apparatus embodying the present invention is applied.

Referring to FIG. 1 of the drawings, a specific system to which an image forming apparatus embodying the present invention is applied is shown. As shown, the system includes a printer or MFP 1 and a host computer or host 2 connected to each other by suitable communication means 3. The printer 1 has, e.g., a digital copier configuration using an electrophotographic process. The printer 1 includes a photoconductive element, not shown, around which a plotter or image forming section 4 (see FIG. 4) is arranged. The plotter 4 actually forms an image and transfers it to a paper or similar recording medium. A paper feed section 6 including a plurality of paper trays 5 and a paper discharge section 7 are respectively arranged upstream and downstream of the plotter 4. The paper feed section 6 allows papers of various sizes including A4 and B5 to be stacked in either one of a short-edge feed position and a long-edge feed position, as desired. A finisher 8 (see FIG. 4) is associated with the paper discharge section 7. The finisher 8 has a stapling function as well as a punching function and is capable of stapling papers sequentially driven out of the printer 1 when a staple mode is selected. In the illustrative embodiment, the plotter 4 has a circulation path including a duplex copy tray and is capable of printing images on both sides of a paper when a duplex copy mode is selected.

Figure 2:
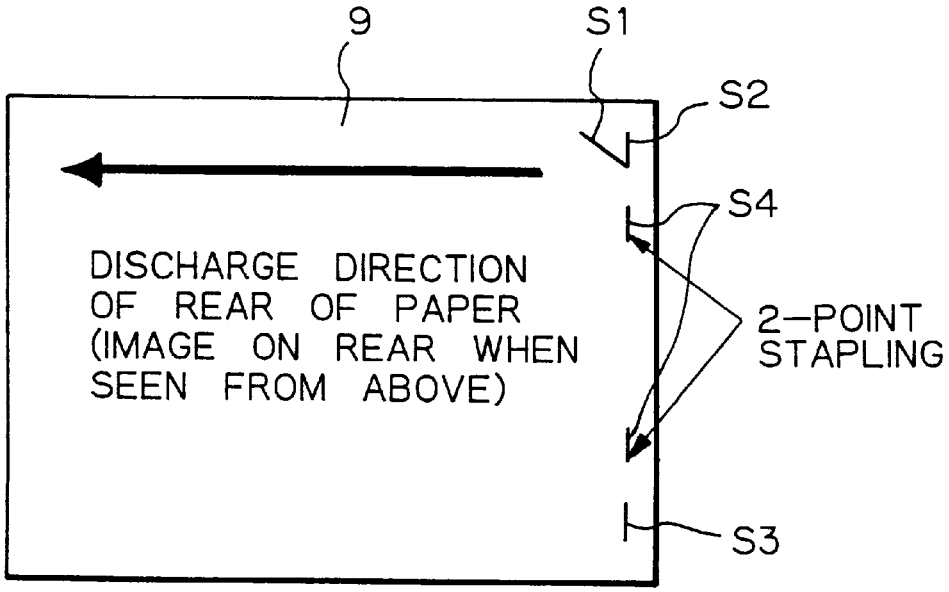
FIG. 2 is a plan view showing the mechanical stapling points of a paper available with the illustrative embodiment.

As shown in FIG. 2, four different mechanical stapling patterns are available with the finisher 8. In FIG. 2, an arrow indicates a direction in which the rear of a paper 9 is driven out of the printer 1; the paper 9 carries an image on the rear when seen from the above. The trailing edge portion of the paper 9 in the above direction is stapled in any one of the four patterns, i.e., a rear oblique stapling pattern S1, a rear vertical stapling pattern S2, a front stapling pattern S3, and a two-point stapling pattern S4. The words "front" and "rear" refer to the sides as seen from the front of the printer 1.

Figure 3:
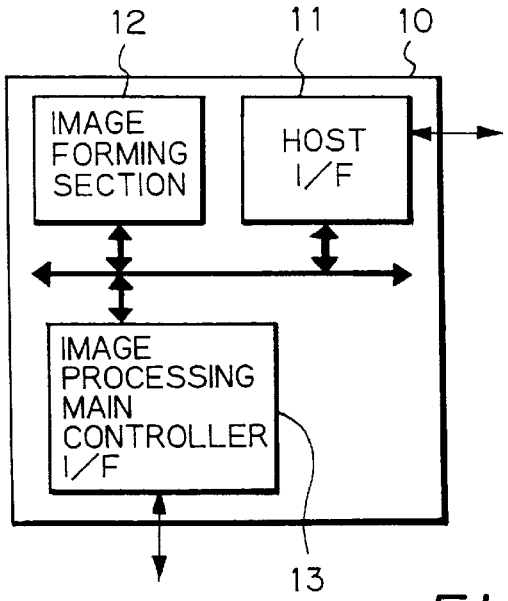
FIG. 3 is a block diagram schematically showing a printer controller included in the illustrative embodiment.

As shown in FIG. 1, a printer controller 10 is mounted on the printer 1 and connected to the host computer 2. As shown in FIG. 3, the printer controller 10 includes a suitable host interface (I/F) 11 for interchanging data with the host computer 2. Specifically, the host I/F 11 informs the host computer 2 of the statuses of an image forming section 12 and receives print data relating to a text from the computer 2. The image forming section 12 interprets the print data (usually print data commands) received via the host I/F 11 and transforms them to electronic image data. On completing one page of image data, the image forming section 12 sends the image data via an image processing main controller I/F 13 in order to show the paper feed section 6 a particular paper tray and to show the paper discharge section 7 and finisher 8 a particular paper discharging method.

Figure 4:
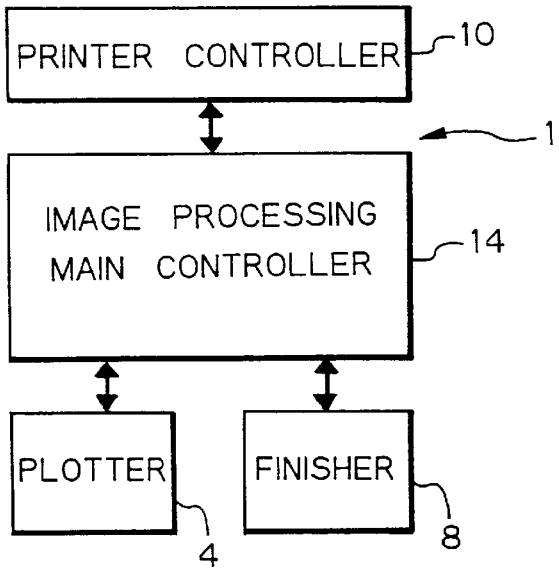
FIG. 4 is a block diagram schematically showing a printer also included in the illustrative embodiment.

As shown in FIG. 4, an image processing main controller 14 included in the printer 1 controls paper feed and paper discharge in response to the commands received from the printer controller 10. Further, the main controller 14 feeds the image data or print data received from the printer controller 10 to the plotter 4 while controlling the timing of the data. As a result, the plotter 4 forms an image on the photoconductive element and transfers it to the paper 9. After the image has been fixed on the paper 9 at a fixing station, the paper or printing 9 is driven via the paper discharge section 7, FIG. 1, including the finisher 8. When the finishing function is selected before printing, the printing 9 is discharged after being stapled, punched or otherwise finished by the finisher 8.

Figure 5:
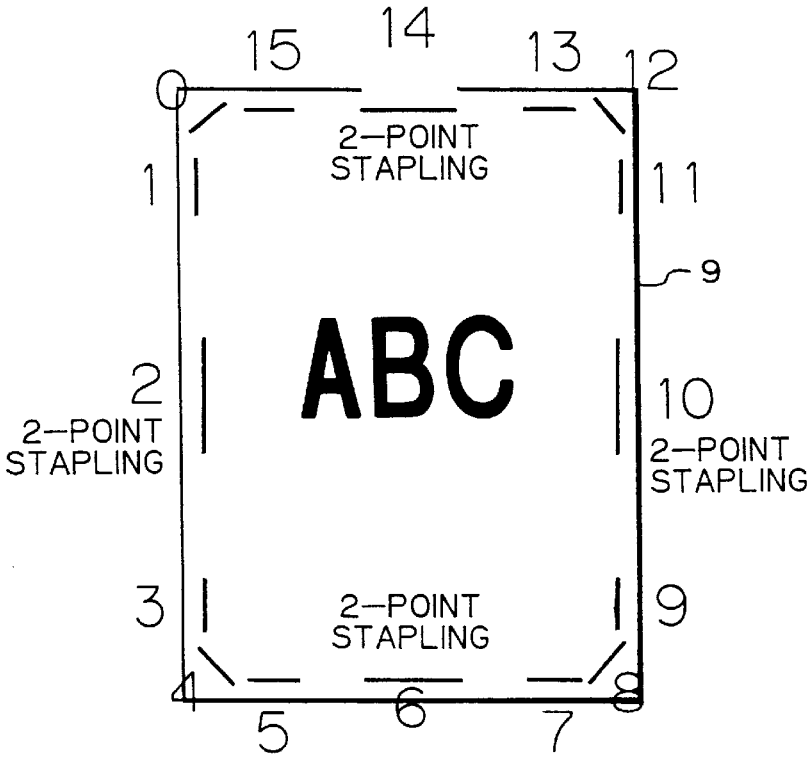
FIG. 5 is a plan view showing specific staple patterns available with the illustrative embodiment.

The stapling function available with the illustrative embodiment will be described more specifically hereinafter. Assume that the operator of the host computer 2 inputs a text or a graphic pattern with a certain application and then inputs a print command. Then, a printer driver, not shown, starts operating and allows the operator to input desired printing conditions. Assume that the finisher 8 has a stapling function mechanically implementing the four different stapling patterns shown in FIG. 2. Then, when the paper feed direction is taken into account, sixteen different stapling patterns represented by parameters "0", through "15" shown in in FIG. 5 are theoretically available.

The operator selects a desired printing direction (portrait/landscape), a desired paper size, a desired stapling point or points and pattern, and a simplex/duplex copy mode (including a stapling direction). When the operator inputs a print start command on the host computer 2, the printer driver generates print command data matching with the printer 1 while taking account of text information, finisher information, etc. The host computer 2 sends such data to the printer 1 via its own communication means (host I/F). The printer receives the print command data via the host I/F 11 of the printer controller 10 and transfers them to the image forming section 12. The image forming section 12 interprets the command data, as stated earlier. At this instant, the image forming section 12 allocates numbers assigned to the staple patterns by using, e.g., the specific parameters "0" through "15" shown in FIG. 5.

As for a staple command, two different systems are available with the illustrative embodiment, i.e., a conventional precise command system and a unique rough command system. The precise command system will be described with reference to FIGS. 6–9. As shown, the precise command system allows the operator to select only one of various preselected combinations relating to the stapling pattern. Specifically, FIGS. 6 and 7 respectively show combination patterns relating to "portrait short-edge feed" and combination patterns relating to "landscape short-edge feed". FIGS. 8 and 9 respectively show combination patterns relating to "portrait long-edge feed" and combination patterns relating to "landscape long-edge feed". That is, FIGS. 6–9 list the parameters ("0" through "15", FIG. 5) of stapling patterns available with the the paper sizes, paper feed directions and printing directions, and combinations thereof. In FIGS. 6–9, "cancel" refers to a condition wherein the staple command is cancelled because stapling the paper 9 in a desired direction physically impossible. "0/180" is representative of the angle of rotation of image data effected by the printer controller 10 for stapling the paper 9 in a desired direction. Further, "cancel staples" refers to a condition wherein the staple command is cancelled because the duplex copy mode and stapling direction in the desired combination are contradictory. In any case, as for stapling, the operator must precisely input not only the printing direction (portrait/landscape) and paper size but also a stapling pattern including a stapling point and a stapling direction, e.g., "top left oblique stapling" or "top right oblique stapling".

When the printer driver or the application of the host computer 2 is used as precise command inputting means, the image forming section 12 determines whether or not the desired stapling pattern is acceptable and whether or not the image data must be rotated by 180 degrees, on the basis of the printing direction, paper size, stapling pattern, duplex copy command and stapling direction, and information relating to the papers actually stacked on the trays 5. Subsequently, the image forming section 12 feeds a staple command, a stapling pattern (mechanically any one of the four patterns S1–S4, FIG. 2), duplex copy command and so forth to the image processing main controller 14. The image data are rotated by 180 degrees by the image forming section 12, if necessary.

After the above setting procedure, electronic image data generated by the image forming section 12 are sent to the image processing main controller 14 via the main controller I/F 13. The main controller 14 causes the plotter 4 to form an image on the photoconductive element. The image is transferred from the photoconductive element to the paper 9. After the image has been fixed on the paper 9, the paper or printing 9 is driven out via the paper discharge section 7 including the finisher 8. At this instant, the finisher 8 staples such papers 9 in accordance with a command output from the print controller 10.

Figure 10:
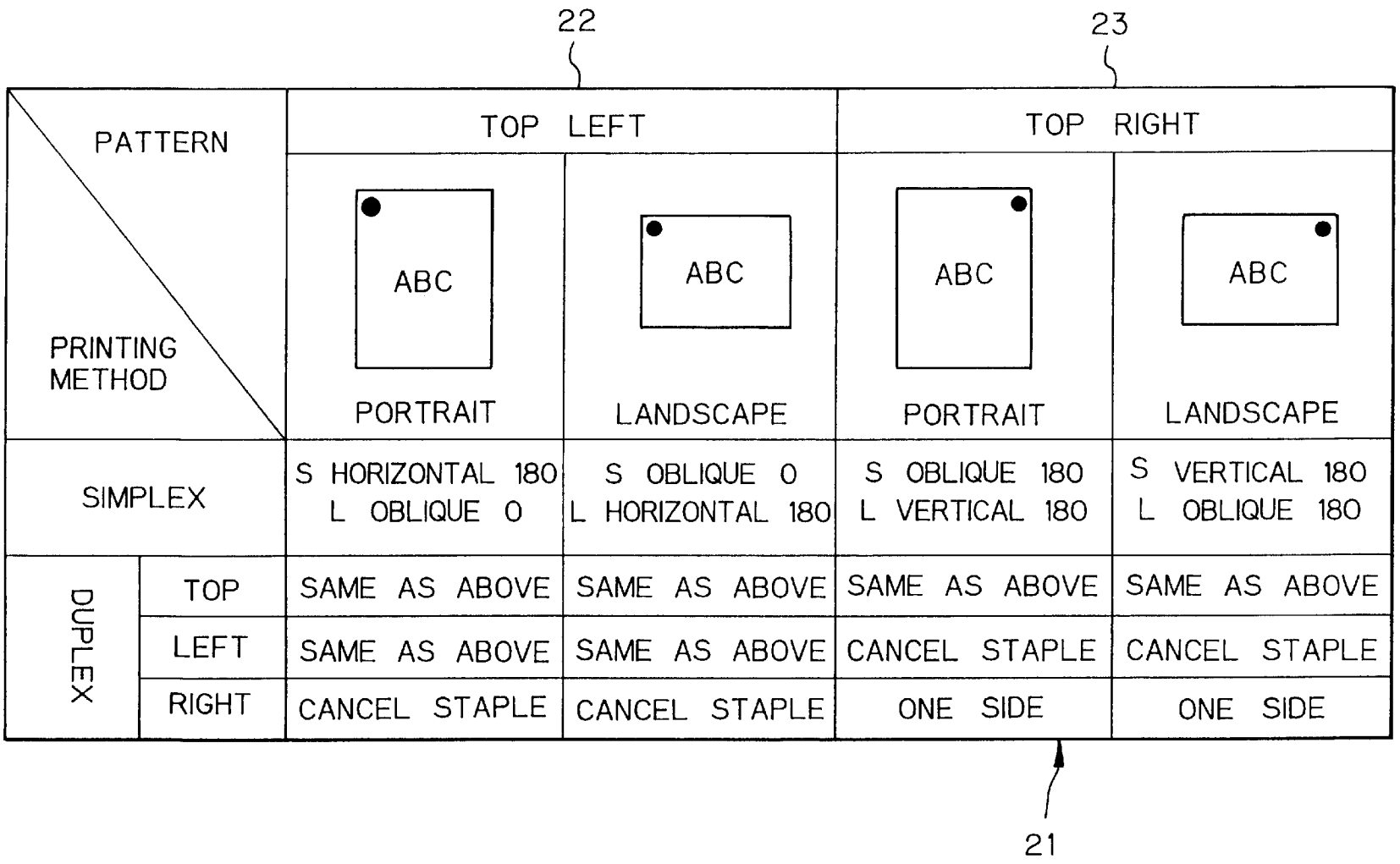
FIG. 10 shows patterns available with a rough command mode unique to the illustrative embodiment.

The rough command system unique to the illustrative embodiment is as follows. FIG. 10 shows specific preselected patterns 21 for the rough command system and each being a particular combination of printing direction, paper feed direction, and stapling point. The patterns 21 allow the operator to roughly select a desired stapling point with redundancy, e.g., "top left" 22 or "top right" 23 together with a desired printing direction, paper feed direction, etc. Such a rough command is also input via the printer driver or the application of the host computer 2 playing the role of rough command inputting means at this time. The patterns 21 are representative of the combinations of printing conditions and stapling patterns for the rough command system. In FIG. 10, "S" and "L" denote short-edge feed long-edge feed, respectively. "horizontal", "oblique" and "vertical" are respectively representative of a horizontal stapling pattern, an oblique stapling pattern, and a vertical stapling pattern. "0/180" indicates the angle of rotation of image data to be effected by the printer controller 10 for stapling the papers in a desired direction. "Cancel Staple" refers to a condition wherein the staple command is cancelled because the duplex copy mode and stapling direction in the desired combination are contradictory. For example, "S horizontal 180" refers to the short-edge feed, horizontal stapling pattern in which image data are rotated by 180 degrees. As for two-point stapling not shown in FIG. 10, the conventional precise command system is applied.

In the rough command system, the operator should only input a rough command, e.g., "top left" or "top right" in place of a precise command, e.g., "top left oblique", "top left horizontal", "top right oblique" or "top right horizontal" via the printer driver of the host computer 2. The processing to follow is basically identical with the processing described in relation to the precise command system. Specifically, the image forming section or decision means 12 determines, based on the pattern 21 selected and the papers stacked on the trays 5, whether or not stapling can be effected and whether or not image data should be rotated by 180 degrees. Subsequently, the image forming section 12 feeds a staple command, a stapling pattern, duplex copy command and so forth to the image processing main controller 14. The image data are rotated by 180 degrees by the image forming section 12, if necessary.

For example, assume that the operator designates the top right corner when the paper size is A4 and the printing direction is portrait. Then, two different stapling patterns are available, i.e., the top right oblique stapling pattern with 180-degree image rotation for the short-edge feed, and the top right vertical stapling pattern with 180-degree image rotation for the long-edge feed. In this case, if only papers of size A4 are stacked on the trays 5 in a short-edge feed position, then the image forming section 12 selects the top right oblique stapling pattern. If the papers of size A4 are stacked on the tray 5 in a long-edge feed position, the image forming section 12 selects the top right vertical stapling pattern. Further, if some of the papers of size A4 are positioned for short-edge feed while the others are positioned for long-edge feed, the image forming section 12 selects either one of them; priority may be given to long-edge feed by way of example.

Giving priority to long-edge feed, as stated above, is advantageous in that the paper processing time ascribable to the image forming operation of the plotter 4 is reduced, enhancing the productivity of printings. Alternatively, priority may be given to the oblique stapling pattern without regard to the paper feed direction. That is, in the above specific case, priority may be given to the top right oblique stapling pattern. With the oblique stapling pattern given priority, a satisfactory result is easy to achieve despite the rough command because the operator, in many cases, designates the oblique stapling pattern when selecting the top left corner or the top right corner. More preferably, the user should be allowed to set a desired priority order, i.e., to give priority to either the productivity of printings or the appearance of stapled printings.

Figures 11, 11A:
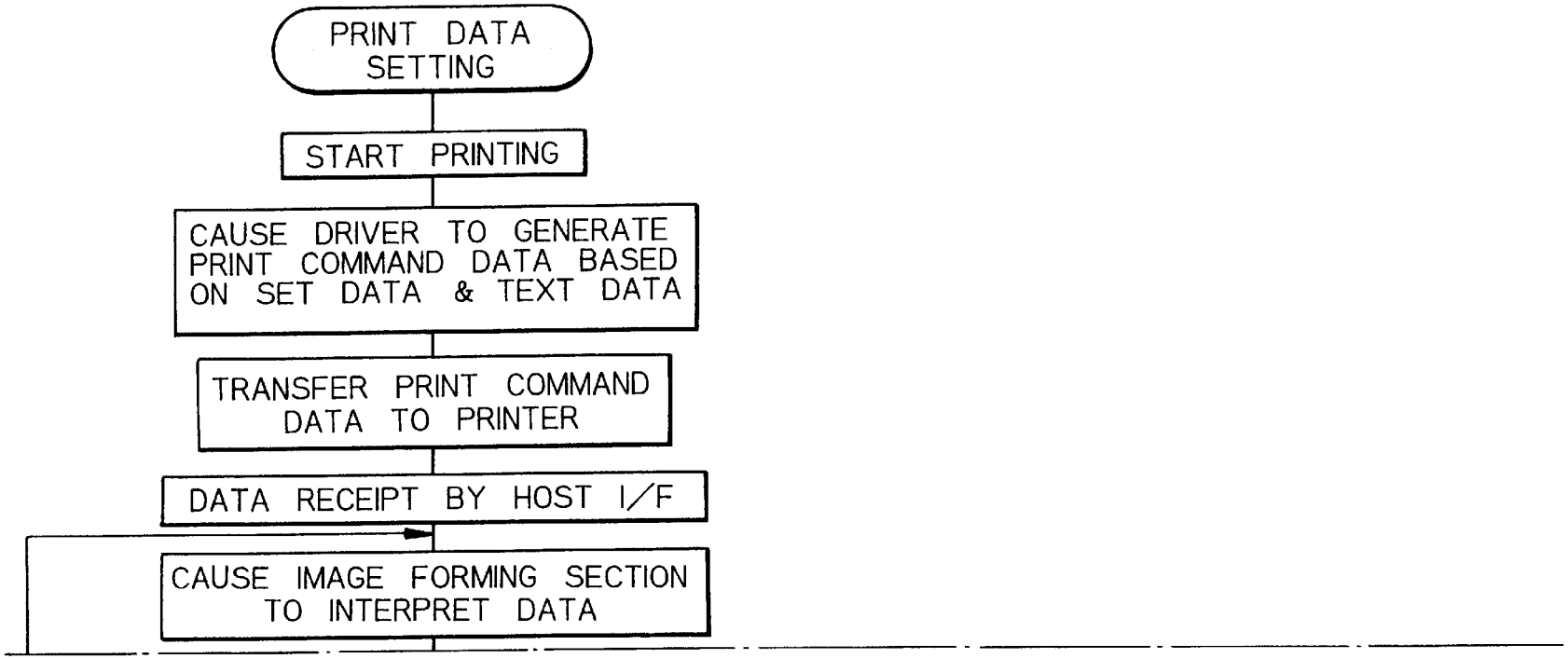
FIG. 11 is a flowchart demonstrating a specific printing procedure of the illustrative embodiment.
Figure 11B:
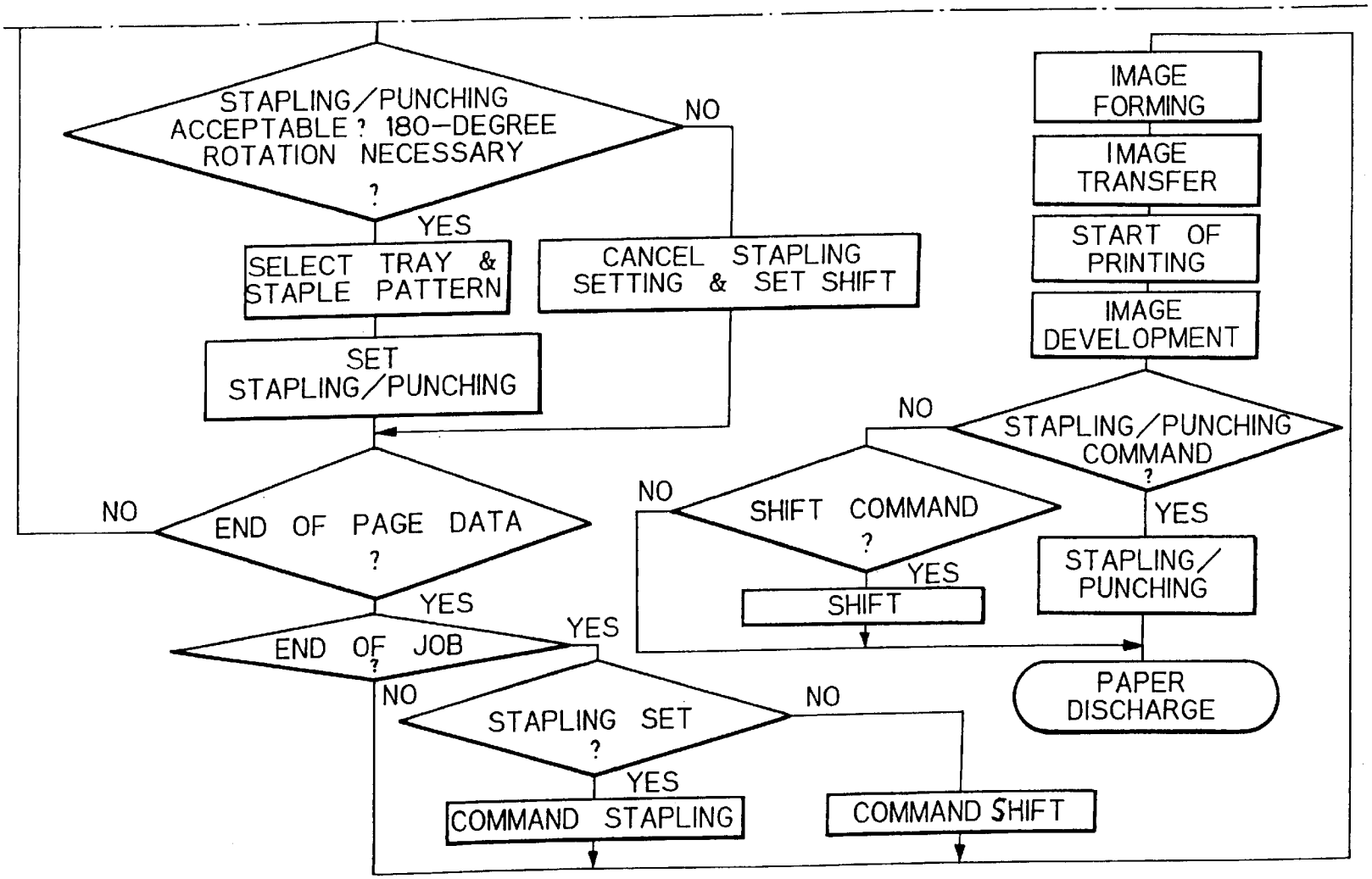

FIG. 11 is a flowchart demonstrating the above procedure beginning with the start of printing and ending with desired finishing.

In summary, the present invention provides an image processing apparatus having the following various unprecedented advantages. A rough stapling position, e.g., the top left corner or the top right corner of a paper can be designated via rough command inputting means, allowing papers to be stapled in a desired pattern with high probability. By giving priority to long-edge feed in the event of rough command, it is possible to reduce the paper processing time ascribable to image formation and therefore to enhance the productivity of printings. When priority is given to an oblique stapling pattern, a satisfactory result is easy to achieve despite the rough command because the operator, in many cases, designates the oblique stapling pattern when selecting the top left corner or the top right corner. Further, the user can set a desired priority order, i.e., give priority to either the productivity of printings in relation to the paper feed direction or the appearance of stapled papers.

Various modifications will become possible for those skilled in the art after receiving the teachings of the present disclosure without departing from the scope thereof.

What is claimed as new and desired to be secured by Letters Patent of the United States is:

1. An image forming apparatus comprising:

a paper feed section including a paper tray allowing papers to be selectively stacked in a short-edge feed position or a long-edge feed position, depending on a size of the papers;

an image forming section for forming, based on at least print data, a paper size and a printing direction received from a host, an image and transferring said image to the paper fed from said paper feed section;

a paper discharge section for discharging the paper to which the image has been transferred by said image forming section;

a finishing section having a stapling function for stapling the papers discharged by said paper discharge section in, among a plurality of patterns each being representative of a particular combination of a stapling point and a stapling direction, a particular pattern selected on the basis of a paper feed direction of the paper and a staple command;

rough command inputting means provided in one of said host and said image forming apparatus for allowing, based on preselected rough command patterns each being representative of a particular combination of a printing direction and a stapling point in relation to said plurality of patterns, a staple command to be roughly input in terms of the printing direction, the paper feed direction, and the stapling point; and decision means for determining, when the staple command is roughly input via said rough command inputting means, a stapling pattern by referencing the paper feed direction, the paper feed direction and said rough command patterns.

2. The apparatus as claimed in claim 1, wherein said decision means gives priority to the papers stacked in the long-edge feed position if the papers can be stapled at a point roughly indicated by the staple command without regard to the position of the papers.

3. The apparatus as claimed in claim 1, wherein said decision means gives priority to an oblique stapling pattern if a horizontal or a vertical stapling pattern and the oblique stapling pattern can be effected at a stapling position roughly indicated by the staple command.

4. The apparatus as claimed in claim 1, wherein said rough command patterns are given any desired priority order in relation to the paper feed direction and the stapling pattern.

5. An image forming method comprising:

selectively stacking, via a paper feed section including a paper tray, papers in a short-edge feed position or a long-edge feed position, depending on a size of the papers;

forming an image, via an forming section, based on at least print data, a paper size and a printing direction received from a host, and transferring said image to the paper fed from said paper feed section;

discharging the paper to which the image has been transferred by said image forming section, via a paper discharge section;

stapling the papers discharged by said paper discharge section in, among a plurality of patterns each being representative of a particular combination of a stapling point and a stapling direction, a particular pattern selected on the basis of a staple command, via a finishing section having a stapling function;

inputting a staple command, via rough command inputting means provided in one of said host and said image forming apparatus, based on preselected rough command patterns each being representative of a particular combination of a printing direction, a paper feed direction and a stapling point in relation to said plurality of patterns, to be roughly input in terms of the printing direction, the paper feed direction, and the stapling point; and determining, when the staple command is roughly input via said rough command inputting means, a stapling pattern by referencing the paper feed direction, the paper feed direction and said rough command patterns, via a decision means.

6. The method of claim 5, comprising:

giving priority to the papers stacked in the long-edge feed position if the papers can be stapled at a point roughly indicated by the staple command without regard to the position of the papers, via said decision means.

7. The method of claim 5, comprising:

giving priority to an oblique stapling pattern if a horizontal or a vertical stapling pattern and the oblique stapling pattern can be effected at a stapling position roughly indicated by the staple command, via said decision means.

8. The method of claim 5, comprising:

giving any desired priority order to said rough command patterns in relation to the paper feed direction and the stapling pattern.

9. An image forming apparatus comprising:

a finisher for stapling a stack of papers, with images formed thereon at any one of a plurality of stapling positions and in any one of a plurality of directions;

wherein patterns for rough commands are respectively assigned to said plurality of stapling positions in a table, and each of said patterns shows a particular combination of a stapling position, a paper feed direction and an image rotation angle for the stack of papers to be stapled.

10. The apparatus as claimed in claim 9, comprising:

determining means for determining the stapling direction, the paper feed direction and image rotation angle, by referencing the table on a basis of a stapling position designated by an operator.

11. An image forming method comprising:

stapling a stack of papers, with images formed thereon, at any one of a plurality of stapling positions and in any one of a plurality directions;

assigning patterns for rough commands respectively to said plurality of stapling positions in a table, said patterns showing a particular combination of a stapling position, a paper feed direction and an image rotation angle for the stack of papers to be stapled.

12. The method as claimed in claim 11, comprising: determining the stapling direction, the paper feed direction and the image rotation angle, by referencing the table on a basis of a stapling position designated by an operator.

* * * * *